US007012571B1

(12) United States Patent
Ozkar et al.

(10) Patent No.: US 7,012,571 B1
(45) Date of Patent: Mar. 14, 2006

(54) MULTIPLE GROUND PLANE SECTION ANTENNA SYSTEMS AND METHODS

(75) Inventors: Mete Ozkar, San Diego, CA (US); Gregory Poilasne, San Diego, CA (US); Thomas Arnold, Carlsbad, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/965,169

(22) Filed: Oct. 13, 2004

(51) Int. Cl.
*H01Q 1/24* (2006.01)
*H01Q 1/48* (2006.01)

(52) U.S. Cl. ..... 343/702; 343/846

(58) Field of Classification Search ..... 343/702, 343/846, 700 MS
See application file for complete search history.

(56) References Cited

U.S. PATENT DOCUMENTS 6,342,859 B1 1/2002 Kurz et al. ..... 343/702
2004/0201523 A1 * 10/2004 Yuanzhu ..... 343/700 MS
2004/0204006 A1 * 10/2004 Zhou et al. ..... 455/550.1

OTHER PUBLICATIONS

Cummings, Nathan P., "Low Profile Integrated GPS and Cellular Antenna", M.S. Thesis at Virginia Polytechnic Inst. & State Univ., Blacksburg, VA, pp. ii-viii & 1-80, Oct. 31, 2001.

* cited by examiner

*Primary Examiner*—Hoang V. Nguyen

(57) ABSTRACT

An antenna grounding connection system is provided for wireless communication devices with two or more ground plane sections. A distance is maintained between an antenna feed and an electrical connection between the two ground plane sections. The distance is determined by the wavelength of the wireless communication signal. The distance should be at least one fifteenth of the wavelength of the wireless communication signal. In the case of a rectangular ground plane section, an antenna feed can be placed near one edge of the first ground plane section, and the electrical connection can be placed near an opposite edge of the first ground plane section.

37 Claims, 5 Drawing Sheets

MULTIPLE GROUND PLANE SECTION ANTENNA SYSTEMS AND METHODS

BACKGROUND OF THE INVENTION

1. Field of the Invention

The invention relates generally to wireless communication and more particularly to systems and methods for antennas with multiple ground plane sections.

2. Background

Consumers are increasingly demanding smaller and smaller feature rich wireless communication devices, such as, for example, cellular telephones (hereinafter "cell phones"). One way to achieve a smaller cell phone with more functions and features is to produce a cell phone with two configurable housing portions. One such configuration is a flip phone. A flip phone opens up like a clam shell. Other such configurations are sliding phones and swivel phones. In a sliding phone, one portion of the cell phone housing slides relative to the other portion. In a swivel phone, one portion of the cell phone swivels open, relative to the other portion. A sliding phone is shown with respect to U.S. patent application Ser. No. 10/931,712, filed on Sep. 1, 2004, attorney docket number UTL 00372, the whole of which is hereby incorporated herein by reference.

Typically one configuration of the two housing portions is smaller than the other configuration. Typically, the smaller configuration is called the closed configuration and the larger configuration is called the open configuration. The cell phone user can keep the cell phone in the closed configuration when carrying the cell phone, or for storage. Then the cell phone can be put in the open configuration to be used. Some phones can be used in both configurations.

In some configurable cell phones, both housing portions have a ground plane. Ground planes effect the performance of any nearby (proximate) antenna. Specifically, an antenna might perform optimally with the cell phone in one configuration, but sub-optimally with the cell phone in the other configuration. The sub-optimal performance could be due to the positional change of one of the ground planes relative to the antenna. Especially, an antenna that depends heavily on the ground plane, such as a patch antenna or a planar inverted F antenna (PIFA), may perform poorly when a grounded metal is near the antenna in some configurations.

SUMMARY OF THE INVENTION

In order to overcome the problems associated with conventional approaches for providing compact antennas for wireless communication devices with two or more ground plane sections, a distance is maintained between the antenna feed and an electrical connection between the two ground plane sections. The distance is determined by the wavelength of the wireless communication signal. The distance should be at least one fifteenth of the wavelength of the wireless communication signal.

In the case of a rectangular ground plane section, an antenna feed can be placed near one edge of the first ground plane section, and the electrical connection can be placed near an opposite edge of the first ground plane section.

The antenna radiation efficiency is the efficiency of the antenna alone, that is, without considering the matching circuitry. In other words, radiation efficiency can be considered as the efficiency of the antenna when the antenna is assumed to have perfect match at all frequencies. Radiation efficiency improves dramatically as a result of moving the ground plane connection away from the antenna feed port.

Other aspects, advantages, and novel features of the invention will become apparent from the following Detailed Description of Preferred Embodiments, when considered in conjunction with the accompanying drawings.

BRIEF DESCRIPTION OF THE DRAWINGS

Preferred embodiments of the present inventions taught herein are illustrated by way of example, and not by way of limitation, in the figures of the accompanying drawings, in which.

DETAILED DESCRIPTION

Figure 1:
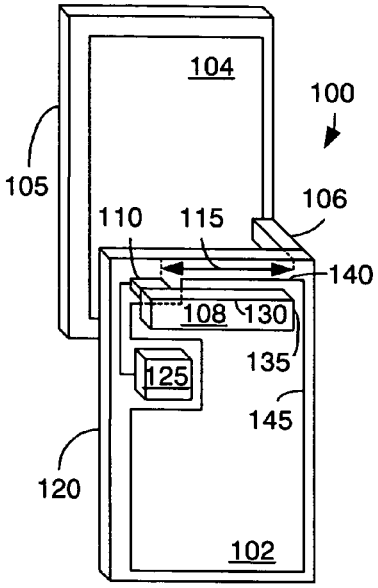
FIGS. 1–3 illustrate perspective views of antenna ground plane systems.

FIG. 1 illustrates a perspective view of antenna ground plane system 100 for transmitting wireless communication signals over the air. System 100 includes a first ground plane section 102 and a second ground plane section 104. The ground plane sections 102 and 104 are configurable, as will be described more fully below with respect to FIGS. 4 and 5. The ground plane sections 102 and 104 overlap partially, as can be seen with respect to FIG. 1.

Electrical connection 106 connects ground plane sections 102 and 104. Antenna 108 is affixed to ground plane section 102. Antenna feed port 110 is located distance 115 away from connection 106. Distance 115 is empirically determined to be at least one fifteenth of the wavelength of the wireless communication signals that are transmitted over the air by system 100. Alternately stated, the distance 115 should be at least one fifteenth of the wavelength corresponding to the first resonance of the antenna. For example, in the case of a quarter wavelength antenna, distance 115 is at least 1/15 times 4=0.267, times the electrical length of antenna 108.

For example, the wireless communication signals may be U.S. cellular communications the U.S. cellular band between 824 MHz and 894 MHz. In that case, distance 115 is at least 2.35 cm. Advantageously, placing connection 106 at least distance 115 away from port 110 provides for greatly increased radiation efficiency for antenna 108. Actual increased radiation efficiency measurements will be described later with respect to FIGS. 6–9. Increased radiation efficiency simulations will be described later with respect to FIGS. 10–11.

Feed port 110 may include a single connection to antenna 108, such as in the case of a patch antenna. In that case, feed port 110 is not directly connected to ground plane section 102. Ground plane section 102 is connected to first printed circuit board (PCB) 120. Ground plane section 102 is shown external to PCB 120, for illustrative purposes. Ground plane section may be internal to PCB 120. For example, ground plane section 102 may be formed in one or more layers of PCB 120. Further, ground plane section 102 may be formed by other means such as flex, metal cans and plated on a housing or structural portion.

Transceiver 125 is also connected to PCB 120. Transceiver 125 is connected to feed port 110. Wireless communication signals are generated by transceiver 125, and passed through feed port 110 to antenna 108. Antenna 108, in conjunction with first and second ground plane sections 102 and 104, radiates the wireless communication signals over the air. Ground plane section 104 is shown attached externally to second PCB 104. Similar to ground plane section 102, ground plane section 104 may be internal to PCB 105. Alternatively, ground plane section 104 may be a small piece of metal such as, for example, an LCD back side or shield or, generally, a piece of metal known in the industry as a can.

Feed port 110 may include an antenna ground connection (now shown) as well. For example, the antenna may be a PIFA. A PIFA has a feed port 110 and an antenna ground connection (not shown). The antenna ground connection could be adjacent to feed port 110. The antenna may be any other convenient type of antenna, such as, for example, a monopole antenna such as a stubby antenna, including a helical stubby antenna.

Antenna 108 may have long edge 130 and short edge 135. In some cases, it is advantageous to position antenna 108 such that long edge 130 of antenna 108 is parallel to ground plane edge 140. This arrangement produces antenna electrical current in a direction parallel to ground plane edge 140. Advantageously, spacing ground plane connection 106 far from feed port 110 causes an increase in ground plane currents responsive to the antenna electrical current. The increased ground plane currents is indicative of increased radiation efficiency, which will be discussed more fully below with respect to FIGS. 6–11.

Radiation efficiency is also improved if ground plane connection 106 is a strong electrical connection, such as a metallic spring or screw. A strong metallic connection will be described more fully with respect to FIG. 12. In one embodiment ground plane connection 106 has a direct current (DC) electrical resistance less than one ohm.

Figure 2:
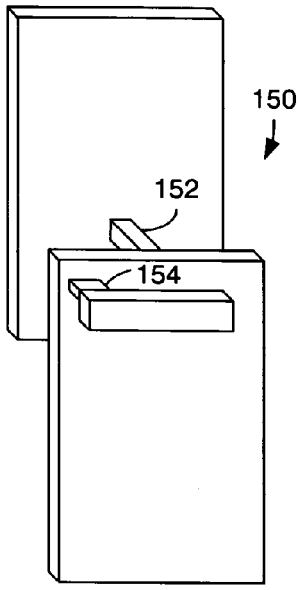

FIG. 2 illustrates a perspective view of antenna ground plane system 150 for transmitting wireless communication signals over the air. In ground plane system 150, ground connection 152 is near antenna feed port 154. This configuration is disadvantageous compared to the arrangement of system 100 shown with respect to FIG. 1. System 150 does not radiate as efficiently as system 100.

Figure 3:
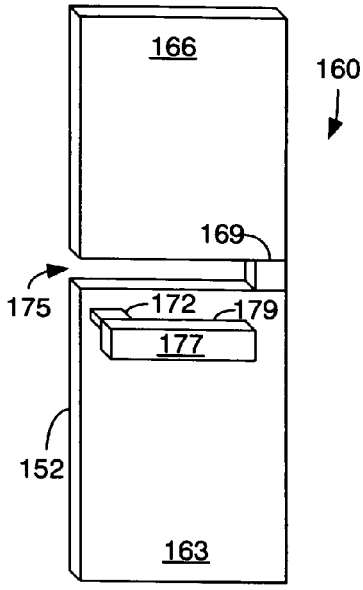

FIG. 3 illustrates a perspective view of antenna ground plane system 160 for transmitting wireless communication signals over the air. In system 160, first ground plane section 163 and second ground plane section 166 are in the same geometrical plane, as can be seen in FIG. 3. Ground plane section 163 and 166 are connected by ground plane connection 169. Ground plane section 163 and 166 are positioned apart from each other forming slot 175. Slot 175 is located proximate to antenna 177 and parallel to a long edge 179 of antenna 177. Advantageously, slot 175 serves to decrease the amount of ground plane near antenna 177, increasing the radiation due to the fringing fields.

Figure 4:
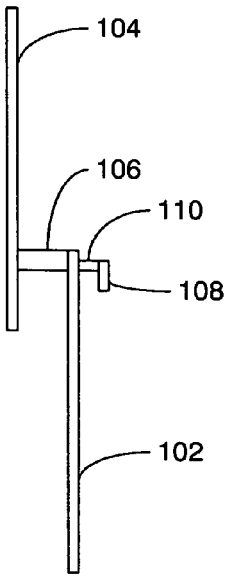
FIG. 4 illustrates a side view of an antenna ground plane system, in a first configuration.

FIG. 4 illustrates a side view of ground plane system 100, shown with respect to FIG. 1. Referring to FIG. 4, ground plane section 104 is connected to ground plane connection 106. Ground plane connection 106 is connected to ground plane section 102. Ground plane section 102 is proximate to feed port 110, as described above with reference to FIG. 1. Referring again to FIG. 4, feed port 110 is connected to antenna 108.

Figure 5:
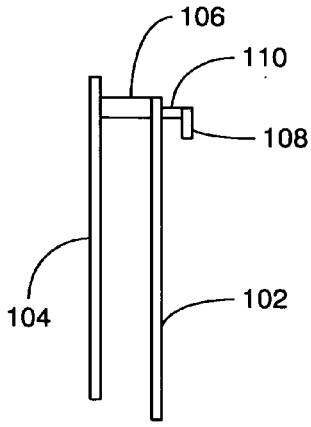
FIG. 5 illustrates a side view of the antenna ground plane system shown with respect to FIG. 4, in a second configuration.

FIG. 4 is shown for comparison to FIG. 5. FIG. 5 has all the same components as FIG. 4, but in FIG. 5, ground plane section 104 is in a lowered position, so that more of ground plane section 104 overlaps with ground plane section 102. The configuration shown in FIG. 4 can be called an open or "slide up" position. The configuration shown in FIG. 5 can be called a closed or "slide down" position. As stated above with respect to FIG. 1, ground plane section 104 may interfere with antenna 108 radiation. Putting connection 106 in the position shown with respect to FIG. 1 helps reduce the negative effects of ground plane 104 interfering with the radiation of antenna 108 when in the "slide up" position. In closed position, it can be advantageous to also have a connection at the bottom between the two boards.

Figure 6:
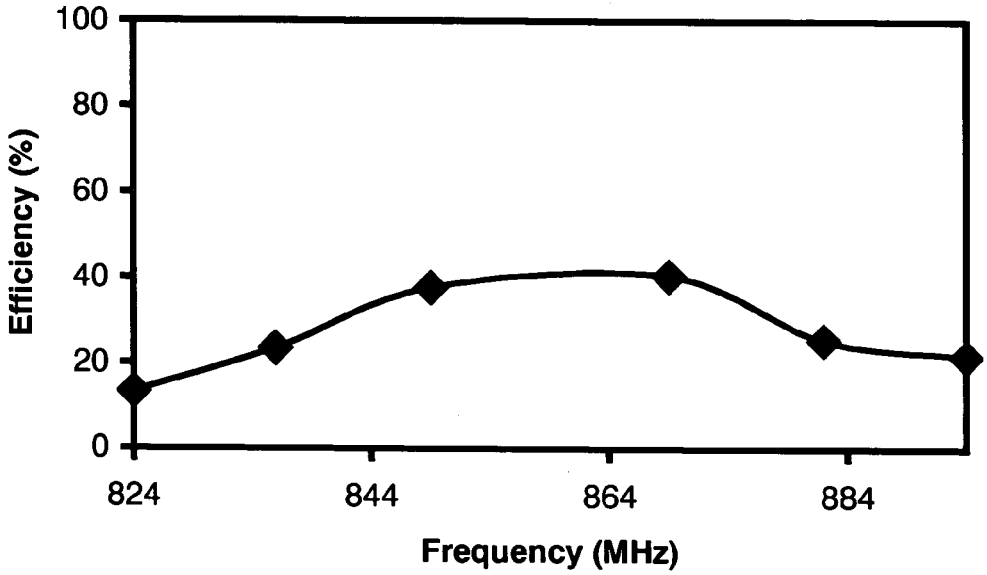
FIG. 6 is a graph showing measured radiation efficiency plotted against frequency for an antenna ground plane system with the electrical connection near the antenna feed port.
Figure 7:
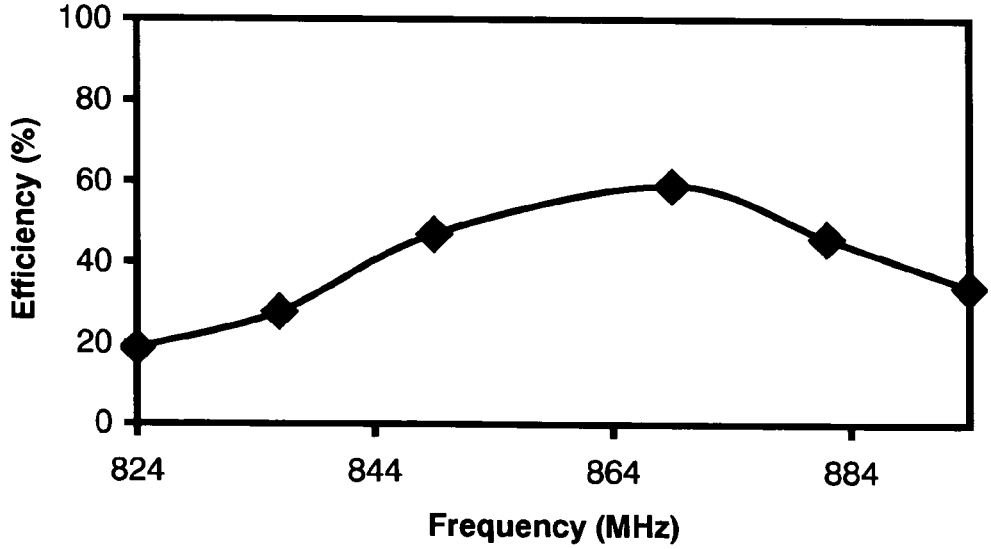
FIG. 7 is a graph showing measured radiation efficiency plotted against frequency for an antenna ground plane system with the electrical connection farther from the antenna feed port.

FIGS. 6–9 are graphs of actual measured radiation efficiencies of an antenna with two different ground connection configurations. FIGS. 6 and 7 show radiation efficiency in the U.S. cellular band. FIG. 7 shows radiation efficiency with ground connection 106 far away from feed 110, as shown with respect to FIG. 1. FIG. 6 shows radiation efficiency with ground connection 152 closer to feed 154, as shown with respect to FIG. 2. The measurements shown in FIG. 6 were taken with a flex ribbon connector for ground connection 152. The measurements shown in FIG. 7 were taken with a solder connection for ground connection 106. Thus, the measurements shown in FIG. 7 were taken with improved ground connection placement relative to the feed and with a stronger electrical connection for the ground connection, as compared to the measurements shown in FIG. 6.

As can be seen by contrasting FIGS. 6 and 7, the improved electrical connection placement and electrical strength resulted in a relative efficiency improvement of about 50%, that is, from about 40% to about 60%, or 3 dB over some of the U.S. cellular band. At the lower edge of the band, at 824 MHz, the relative efficiency improvement is about 30%, from about 15% efficiency to about 20% efficiency.

Figure 8:
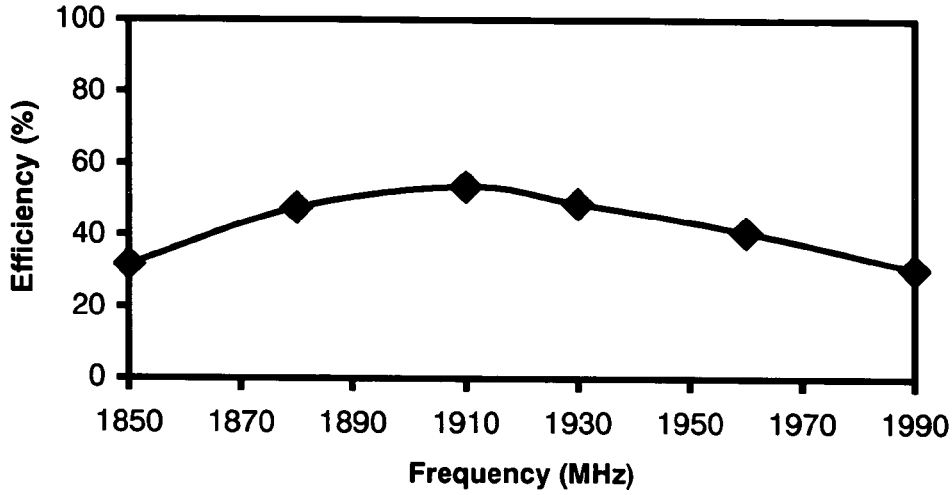
FIG. 8 is a graph showing measured radiation efficiency plotted against frequency for an antenna ground plane system with the electrical connection near the antenna feed port.
Figure 9:
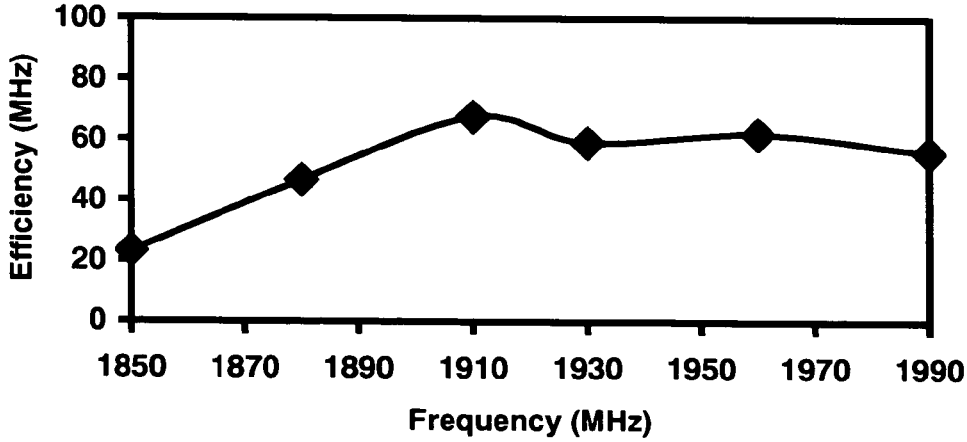
FIG. 9 is a graph showing measured radiation efficiency plotted against frequency for an antenna ground plane system with the electrical connection farther from the antenna feed port.

The antenna tested for the measurements shown in FIGS. 6–9 was a dual band PIFA. Its primary radiating mode is in the U.S. cellular band. Its secondary radiating mode is in the U.S. personal communication service (PCS) band between 1910 MHz and 1990 MHz. FIGS. 8 and 9 show radiation efficiency for the same antenna in the U.S. PCS band. FIG. 9 shows radiation efficiency with ground connection 106 far away from feed 110, as shown with respect to FIG. 1. FIG. 8 shows radiation efficiency with ground connection 152 closer to feed 154, as shown with respect to FIG. 2. The measurements shown in FIG. 8 were taken with a flex ribbon connector for ground connection 152. The measurements shown in FIG. 9 were taken with a solder connection for ground connection 106. Thus, the measurements shown in FIG. 9 were taken with improved ground connection placement relative to the feed and with a stronger electrical connection for the ground connection, as compared to the measurements shown in FIG. 8.

Figure 10:
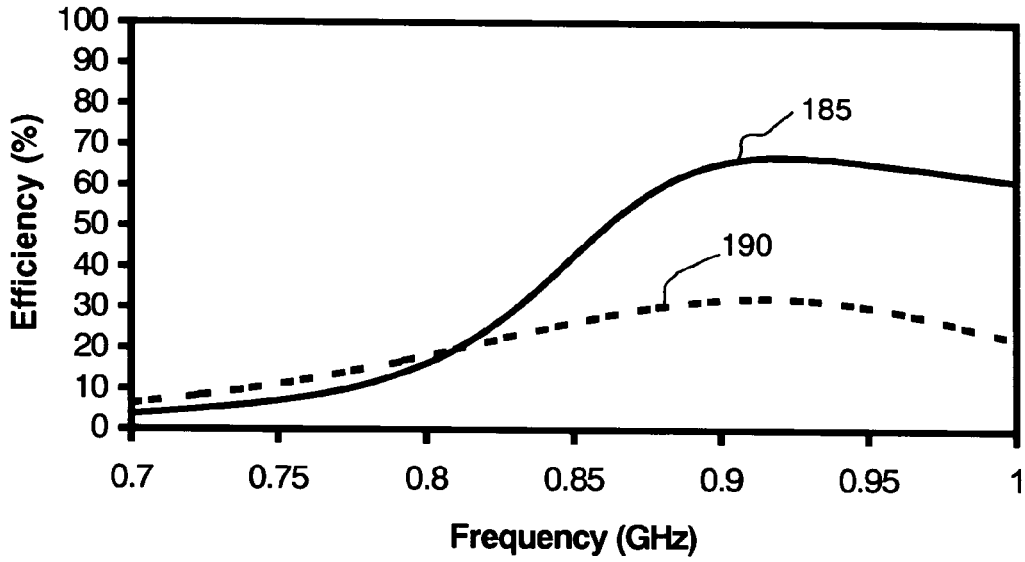
FIG. 10 is a graph showing simulated radiation efficiency plotted against frequency for an antenna ground plane system both with the electrical connection near the antenna feed port and with the electrical connection farther from the antenna feed port.

FIG. 10 shows a graph of simulations of radiation efficiency over a range of frequencies, including the U.S. cellular band. The antenna simulated for the simulations shown with respect to FIG. 10 was a capacitively loaded PIFA. The simulations were made using the commercially available software, IE3D, by Zeland Software, Inc. The software uses the method of moment technique and is widely used for the simulation of planar antennas. Solid line 185 shows simulated radiation efficiency of a PIFA on a ground plane similar to that shown with respect to FIG. 3, having ground connection 169 and slot 175. Dashed line 190 shows simulated radiation efficiency with a solid ground plane, as if ground plane sections 163 and 166 were extended, removing slot 175, shown with respect to FIG. 3.

Figure 11:
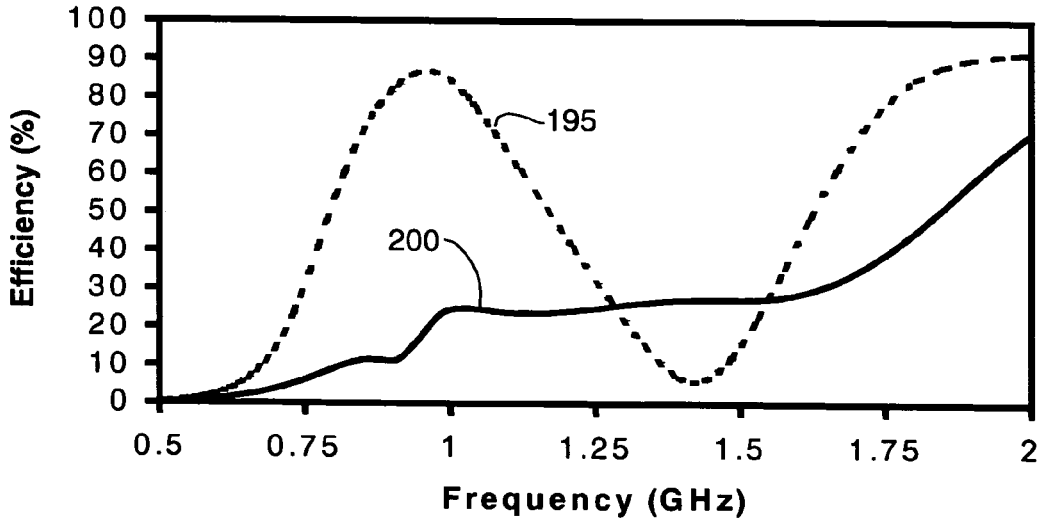
FIG. 11 is a graph showing simulated radiation efficiency plotted against frequency for an antenna ground plane system both with the electrical connection near the antenna feed port and with the electrical connection farther from the antenna feed port.

FIG. 11 shows a graph of simulations of radiation efficiency over a range of frequencies, including the U.S. cellular band and the U.S. PCS band. The antenna used for the simulations shown with respect to FIG. 11 was also a capacitively loaded PIFA. The simulations were made using the commercially available software, IE3D, by Zeland Software, Inc. Dashed line 195 shows simulated radiation efficiency of a PIFA on a ground plane similar to that shown with respect to FIG. 3, having ground connection 169 and slot 175. Solid line 200 shows simulated radiation efficiency with a ground plane connection 169 near antenna feed 172 and slot 175 farther from feed 172, as if ground plane connection 169 was moved to the edge 182 of ground plane section 163 that is adjacent to feed 172, shown with respect to FIG. 3. As can be seen by contrasting dashed line 195 and solid line 200, the radiation efficiency is much better in the U.S. cellular and PCS bands with the connection 169 far from feed 172.

Figure 12:
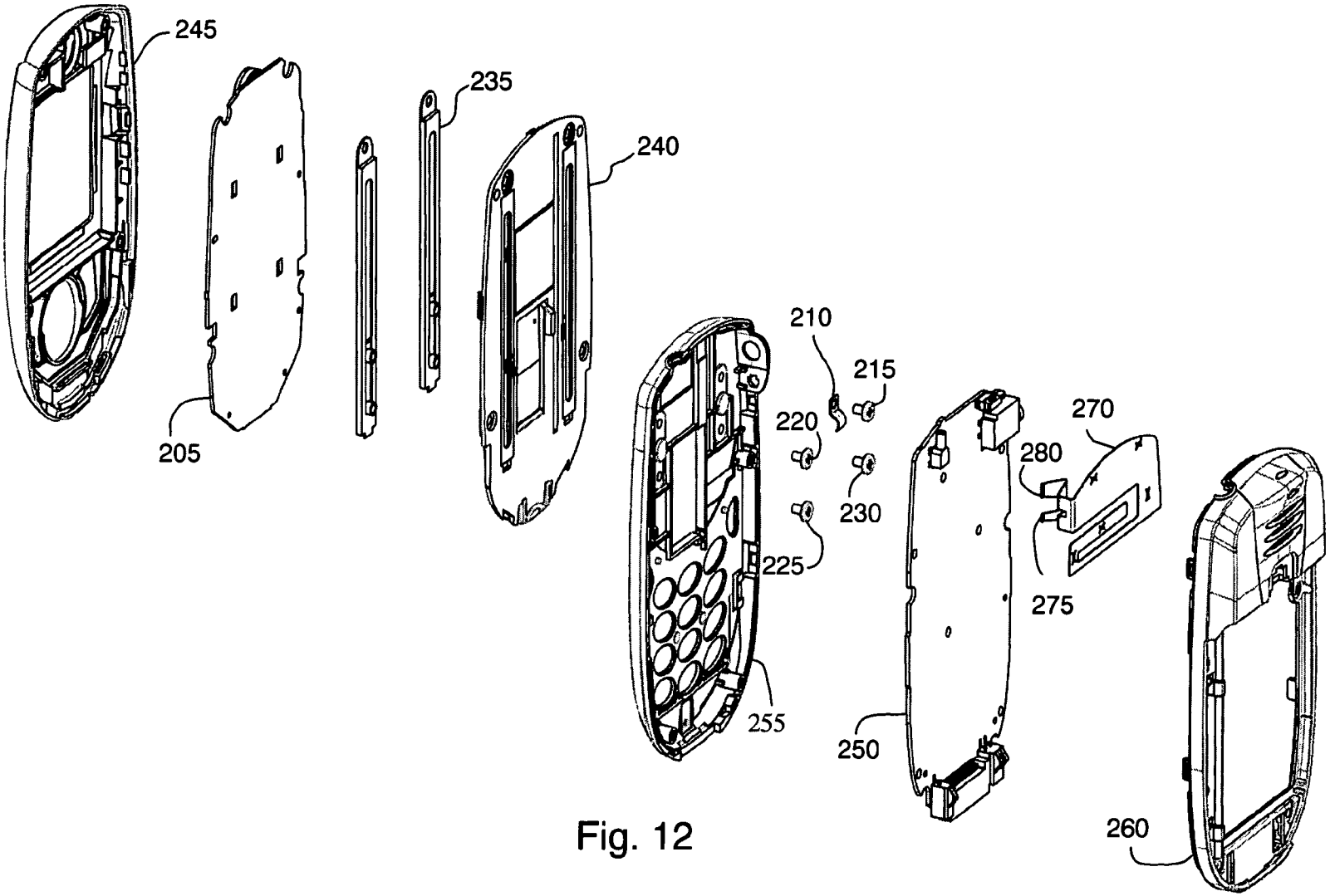
FIG. 12 illustrates a perspective view of a sliding antenna ground plane system, disassembled to show the various parts.

FIG. 12 illustrates a perspective view of a sliding antenna ground plane system, disassembled to show the various parts. First PCB 205 contains first ground plane section (not shown) in one or more layers of first PCB 205. First ground plane section is electrically connected to spring tab 210 through first screw 215 and rail 235. Other screws 220, 225 and 230 are also shown. Screw 215 fastens spring clip 210 to rail 235. Rail 235 is fastened to PCB 205 by a fifth screw (not shown) clamping rail 235 and PCB 205 between first front housing portion 240 and second front housing portion 245. Rail 235 makes contact with a trace (not shown) on PCB 205.

Spring tab 210 makes contact with a second trace (not shown) on the back of second PCB 250. Second PCB 250 contains second ground plane section (not shown) in one or more layers of second PCB 250. Second PCB 250 is clamped between first rear housing portion 255 and second rear housing portion 250 by four more screws (not shown). Advantageously, rail 235, screw 215 and spring tab 210 form a strong electrical connection (at RF and DC) between first ground plane section and second ground plane section. The electrical connection formed between first and second ground plane sections has a DC resistance less than one ohm. The configuration described with reference to FIG. 12 also allows for first and second ground plane sections to slide in position relative to one another.

Antenna 270 is a PIFA, having a feed connection 275 and a ground connector 280. Feed connection 275 connects to antenna feed port (not shown) which is printed on second PCB 250. Antenna ground connector 280 connects to antenna ground connection (not shown) which is printed on second PCB 250.

Further, while embodiments and implementations of the invention have been shown and described, it should be apparent that many more embodiments and implementations are within the scope of the invention. Accordingly, the invention is not to be restricted, except in light of the claims and their equivalents.

What is claimed is:

1. An antenna system comprising:

an antenna feed port;

an antenna connected to the antenna feed port, the antenna having an electrical length;

a first ground plane section proximate to the antenna feed port;

a second ground plane section; and an electrical connection connecting the second ground plane section to the first ground plane section, wherein a distance between the antenna feed port and the electrical connection is at least one fifteenth of a wavelength associated with a first resonance of the antenna.

2. The antenna system of claim 1, further comprising an antenna ground connection connecting the antenna to the first ground plane section.

3. The antenna system of claim 2, wherein the antenna is a planar inverted F antenna.

4. The antenna system of claim 1, wherein the electrical connection comprises a first strong electrical connection to the first ground plane section and a second strong electrical connection to the second ground plane section.

5. The antenna system of claim 4, wherein a DC resistance of the electrical connection is less than one ohm.

6. The antenna system of claim 1, wherein the electrical connection comprises a metallic mechanical connector.

7. The antenna system of claim 6, wherein the metallic mechanical connector comprises a screw and a spring.

8. The antenna system of claim 6, wherein the metallic mechanical connector comprises a hinge.

9. The antenna system of claim 6, wherein the metallic mechanical connector comprises a sliding rail.

10. The antenna system of claim 1, further comprising a transceiver circuit, the transceiver circuit having a ground connection, wherein the ground connection is connected to the first ground plane section.

11. The antenna system of claim 10, further comprising:

a printed circuit board, wherein the first ground plane section is printed on the printed circuit board.

12. The antenna system of claim 11, further comprising:

a second printed circuit board, wherein the second ground plane section is printed on the second printed circuit board.

13. A cellular telephone antenna system comprising:

a first cellular telephone housing portion;

a second cellular telephone housing portion movably connected to the first cellular telephone housing portion;

a first ground plane section affixed to the first cellular telephone housing portion;

a second ground plane section affixed to the second cellular telephone housing portion;

an electrical connector connecting the first ground plane section to the second ground plane section; and an antenna feed port proximate to the first ground plane section.

14. The cellular telephone antenna system of claim 13, wherein the electrical connector comprises a screw and a spring.

15. The cellular telephone antenna system of claim 13, wherein the electrical connector comprises a hinge.

16. The cellular telephone antenna system of claim 13, further comprising an antenna connected to the antenna feed port, the antenna having a first resonance and wherein the electrical connector is at least one fifteenth of a wavelength associated with the first resonance of the antenna away from the antenna feed port.

17. The cellular telephone antenna system of claim 13, wherein the first cellular telephone housing portion is slidably connected to the second cellular telephone housing portion.

18. The cellular telephone antenna system of claim 17, further comprising:

a track mounted to the first ground plane section; and a rail mounted inside the track;

and wherein the electrical connector comprises a spring and wherein the spring is connected to the rail.

19. The cellular telephone antenna system of claim 13, wherein the first cellular telephone housing portion is rotatably connected to the second portion.

20. An antenna system comprising:

antenna connecting means for connecting an antenna;

radiating means for radiating, connected to the antenna connecting means, the radiating means having an electrical length;

first grounding means for providing an electrical ground, the first grounding means being proximate to the antenna connecting means;

second grounding means for providing a further electrical ground; and electrical connecting means for connecting the second grounding means to the first grounding means, wherein a distance between the antenna connecting means and the electrical connecting means is at least one fifteenth of a wavelength associated with a first resonance of the radiating means.

21. The antenna system of claim 20, further comprising antenna ground connection means for connecting the radiating means to the first grounding means.

22. The antenna system of claim 21, wherein the radiating means is a planar inverted F antenna.

23. The antenna system of claim 20, wherein the electrical connecting means comprises a first strong electrical connection to the first grounding means and a second strong electrical connection to the second grounding means.

24. The antenna system of claim 23, wherein a DC resistance of the electrical connecting means is less than one ohm.

25. The antenna system of claim 20, wherein the electrical connecting means comprises a metallic mechanical connector.

26. The antenna system of claim 25, wherein the metallic mechanical connector comprises a screw and a spring.

27. The antenna system of claim 25, wherein the metallic mechanical connector comprises a sliding rail.

28. The antenna system of claim 20, further comprising transceiving means, the transceiving means having a ground connection, wherein the ground connection is connected to the first grounding means.

29. The antenna system of claim 28, further comprising:

a printed circuit board, wherein the first grounding means is printed on the printed circuit board.

30. The antenna system of claim 29, further comprising:

a second printed circuit board, wherein the second grounding means is printed on the second printed circuit board.

31. A cellular telephone antenna system comprising:

a first cellular telephone housing means for housing a first portion of a cellular telephone;

a second cellular telephone housing means for housing a second portion of the cellular telephone, the second cellular telephone housing means movably connected to the first cellular telephone housing means;

a first grounding means affixed to the first housing means;

a second grounding means affixed to the second housing means;

electrical connecting means connecting the first ground plane section to the second ground plane section; and antenna connecting means for connecting an antenna, the antenna connecting means being proximate to the first grounding means.

32. The cellular telephone antenna system of claim 31, wherein the electrical connecting means comprises a screw and a spring.

33. The cellular telephone antenna system of claim 31, wherein the electrical connecting means comprises a hinge.

34. The cellular telephone antenna system of claim 31, further comprising radiating means connected to the antenna connecting means, the radiating means having an electrical length and wherein the electrical connecting means is at least one fifteenth of a wavelength associated with a first resonance of the antenna away from the antenna connecting means.

35. The cellular telephone antenna system of claim 31, wherein the first portion is slidably connected to the second portion.

36. The cellular telephone antenna system of claim 35, further comprising:

a track mounted to the first ground plane section; and a rail mounted inside the track;

and wherein the connector comprises a spring and wherein the spring is connected to the rail.

37. The cellular telephone antenna system of claim 31, wherein the first portion is rotatably connected to the second portion.

* * * * *